US010779633B2

(12) United States Patent
Hartley

(10) Patent No.: US 10,779,633 B2
(45) Date of Patent: Sep. 22, 2020

(54) FOLDING CHAIR CARRIER

(71) Applicant: Mark Hartley, Veneta, OR (US)

(72) Inventor: Mark Hartley, Veneta, OR (US)

( * ) Notice: Subject to any disclaimer, the term of this patent is extended or adjusted under 35 U.S.C. 154(b) by 0 days.

(21) Appl. No.: 16/298,036

(22) Filed: Mar. 11, 2019

(65) Prior Publication Data

US 2020/0069035 A1 Mar. 5, 2020

Related U.S. Application Data

(60) Provisional application No. 62/724,762, filed on Aug. 30, 2018.

(51) Int. Cl.

| | |
|---|---|
| ***A45F 3/04*** | (2006.01) |
| ***A45C 5/06*** | (2006.01) |
| ***A45C 13/30*** | (2006.01) |
| ***A45C 5/03*** | (2006.01) |
| ***A45C 13/26*** | (2006.01) |
| *A45C 5/14* | (2006.01) |

(52) U.S. Cl.

CPC ..... *A45F 3/04* (2013.01); *A45C 5/03* (2013.01); *A45C 5/06* (2013.01); *A45C 13/26* (2013.01); *A45C 13/30* (2013.01); *A45C 5/14* (2013.01); *A45C 2013/306* (2013.01); *A45F 2200/05* (2013.01)

(58) Field of Classification Search

CPC ..... A45F 3/02; A45F 3/04; A45C 5/03; A45C 5/06; A45C 13/26; A45C 13/30; A45C 5/14; A45C 2013/306; A45C 2200/05

USPC ..... 224/584, 269; 24/3.11, 3.12; 248/690–692; 220/482

See application file for complete search history.

(56) References Cited

U.S. PATENT DOCUMENTS

| | | | | |
|---|---|---|---|---|
| 4,901,897 | A * | 2/1990 | Briggs | A45C 3/004 206/287.1 |
| 5,054,589 | A * | 10/1991 | Bomes | A45C 3/00 190/110 |
| 5,570,829 | A * | 11/1996 | Harrison | A45F 3/04 150/158 |
| 5,810,230 | A * | 9/1998 | Nutto | B62J 7/04 224/417 |
| 5,893,504 | A | 4/1999 | Baronian et al. | |
| 7,118,172 | B1 | 10/2006 | Pattison-Sheets | |
| 8,820,522 | B2 * | 9/2014 | Quarry | A45C 5/04 206/315.1 |

(Continued)

*Primary Examiner* — Adam J Waggenspack

(74) *Attorney, Agent, or Firm* — Boudwin Intellectual Property; Daniel Boudwin

(57) ABSTRACT

A carrier for multiple folding chairs. The carrier for multiple folding chairs has a body including a back, at least one sidewall extending around the perimeter of the back, and a closure flap, thereby defining an interior volume. The interior volume is large enough to encapsulate at least two folding chairs. The closure flap is secured to the open ends of the sidewalk via an attachment mechanism such as a zipper. The closure flap also incorporates an access flap, allowing an individual to access a portion of the carrier while the remainder remains closed. Handles, casters and at least one strap are located on the exterior surface of the body, allowing an individual to transport the carrier via several methods. Hooks on the exterior of the body, coupled with fasteners incorporated on the straps, removably secure the carrier to a mounting fixture affixed to a vehicle.

20 Claims, 9 Drawing Sheets

(56) References Cited

U.S. PATENT DOCUMENTS

| | | | | |
|---|---|---|---|---|
| 8,870,414 | B2 * | 10/2014 | Goeckel | F21V 7/00 362/249.03 |
| 9,055,805 | B2 * | 6/2015 | Koutouras | A45C 13/02 |
| 9,440,696 | B2 * | 9/2016 | Sakai | B62J 7/04 |
| 10,010,159 | B1 * | 7/2018 | Gonzales | A45F 3/12 |
| 10,076,166 | B2 * | 9/2018 | Kim | B65D 21/0201 |
| 2005/0140103 | A1 | 6/2005 | Marchant et al. | |
| 2010/0051659 | A1 * | 3/2010 | Ferrari | A45F 3/04 224/197 |
| 2011/0162931 | A1 * | 7/2011 | Collins | A45C 5/14 190/8 |
| 2012/0255983 | A1 * | 10/2012 | Semone | B62J 9/00 224/585 |
| 2012/0286008 | A1 * | 11/2012 | Ackeret | B60R 7/10 224/275 |
| 2013/0126567 | A1 * | 5/2013 | Antonio | A45C 13/1046 224/257 |
| 2015/0014949 | A1 * | 1/2015 | Dittman | B62B 3/003 280/47.17 |
| 2015/0164203 | A1 * | 6/2015 | Filous | A45C 3/001 224/583 |
| 2016/0324300 | A1 | 11/2016 | Wronski | |
| 2017/0127805 | A1 * | 5/2017 | Kotter | A45F 3/08 |
| 2019/0059563 | A1 * | 2/2019 | Logan | A45C 7/0027 |

* cited by examiner

FOLDING CHAIR CARRIER

CROSS REFERENCE TO RELATED APPLICATIONS

This application claims the benefit of U.S. Provisional Application No. 62/724,762 filed on Aug. 30, 2018. The above identified patent application is herein incorporated by reference in its entirety to provide continuity of disclosure.

BACKGROUND OF THE INVENTION

Foldable or collapsible chairs are commonly used in a variety of settings including campsites, picnics, sporting events, and as extra seating in the home. Typically, the folding chairs are stored in individual carrying bags which may or may not include a handle or strap attached to the bag. Accordingly, each folding chair must be stored and carried independently, which can be quite difficult and awkward if a person desires to transport multiple folding chairs at the same time. In some instances, folding chairs are left outside, leaving them susceptible to inclement weather where they can become wet and dirty. This exposure to the elements may drastically shorten the life of the folding chairs.

Although devices have been disclosed in the known art that relate to folding chair carriers, these devices are limited to either being carried on the shoulders of an individual or pushed along a surface. In view of the disadvantages inherent in the known types of carriers for folding chairs now present in the known art, the present invention provides a carrier for multiple folding chairs wherein the same can be utilized in a manner compatible with outdoor exposure. More particularly, the present invention provides for a durable and flexible carrier that is configured to protect multiple folding chairs from the weather. The present invention includes shoulder straps with fasteners, handles, casters and hooks such that the carrier can be transported via a wide variety of methods, including by securing the carrier to a mounting fixture affixed to a vehicle.

The present invention substantially diverges in design elements from the known art while at the same time provides convenience to the user. In this regard the present invention substantially fulfills these needs.

SUMMARY OF THE INVENTION

In view of the foregoing disadvantages inherent in the known types of folding chair carriers, the present invention provides a carrier for multiple folding chairs. The carrier for multiple folding chairs has a body including a back, at least one sidewall extending around the perimeter of the back, and a closure flap, thereby defining an interior volume. The interior volume is large enough to encapsulate at least two folding chairs. The closure flap is secured to the open ends of the sidewalls via an attachment means such as a zipper. The closure flap also incorporates an access flap, allowing an individual to access a portion of the carrier while the remainder remains closed. Handles, casters, and at east one strap are located on the exterior surface of the body, allowing an individual to transport the carrier via several methods. Hooks on the exterior of the body, coupled with fasteners incorporated in the straps, removably secure the carrier to a mounting fixture affixed to a vehicle.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and the manner in which it may be made and used may be better understood after a review of the following description, taken in connection with the accompanying drawings wherein like numeral annotations are provided throughout.

DETAILED DESCRIPTION OF THE INVENTION

Figure 1A:
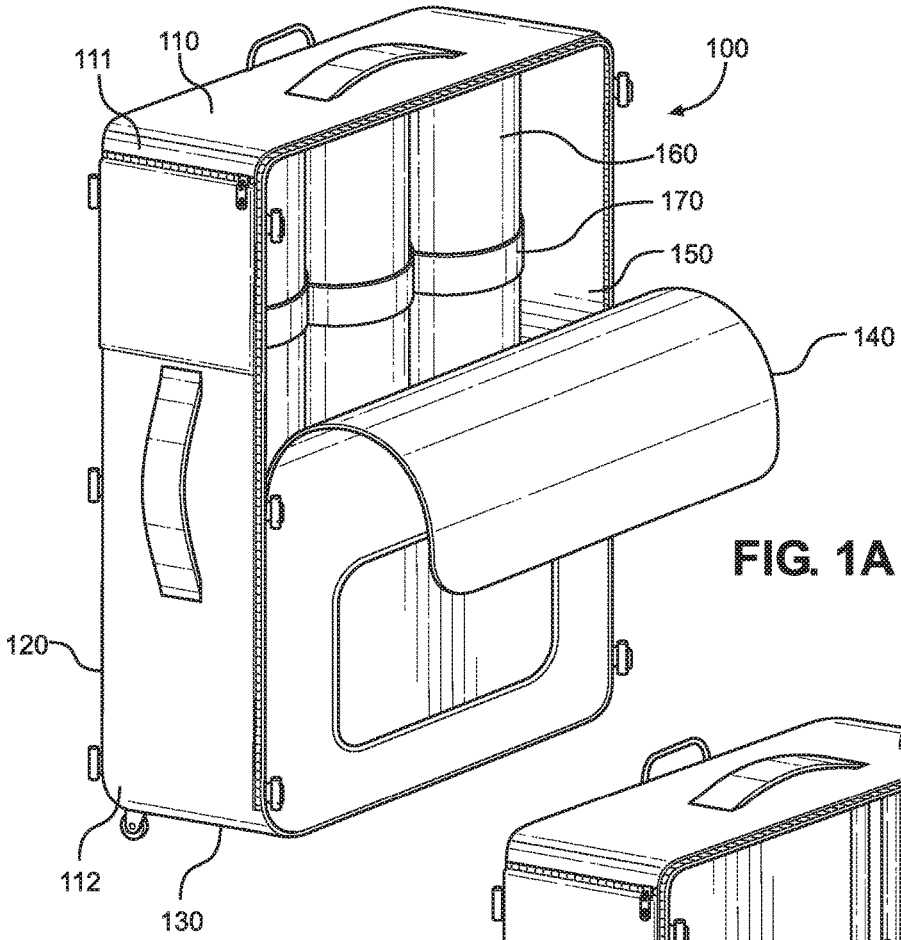
FIG. 1A shows a perspective view of an embodiment of the carrier for multiple folding chairs in an open configuration, with folding chairs in individual carriers secured in the interior.

Reference is made herein to the attached drawings. Like reference numerals are used throughout the drawings to depict like or similar elements of the carrier for multiple folding chairs. For the purposes of presenting a brief and clear description of the present invention, a preferred embodiment will be discussed as used for the carrier for multiple folding chairs. The figures are intended for representative purposes only and should not be considered limiting in any respect.

Referring now to FIG. 1A, there is shown a perspective view of an embodiment of the carrier for multiple folding chairs in an open configuration, with folding chairs in individual carriers secured in the interior. The carrier for multiple folding chairs 100 has a body 110, having a top end 111 and a bottom end 112, a back 120, at least one sidewall 130 extending around the perimeter of the back 120, and a closure flap 140, thereby defining an interior volume 150. In the preferred embodiment, the body 110 is composed of a flexible and durable textile that is weather and ultra-violet resistant. It is contemplated by this disclosure that the body may be composed of many different weather-resistant materials which can embody the present invention.

Figure 1B:
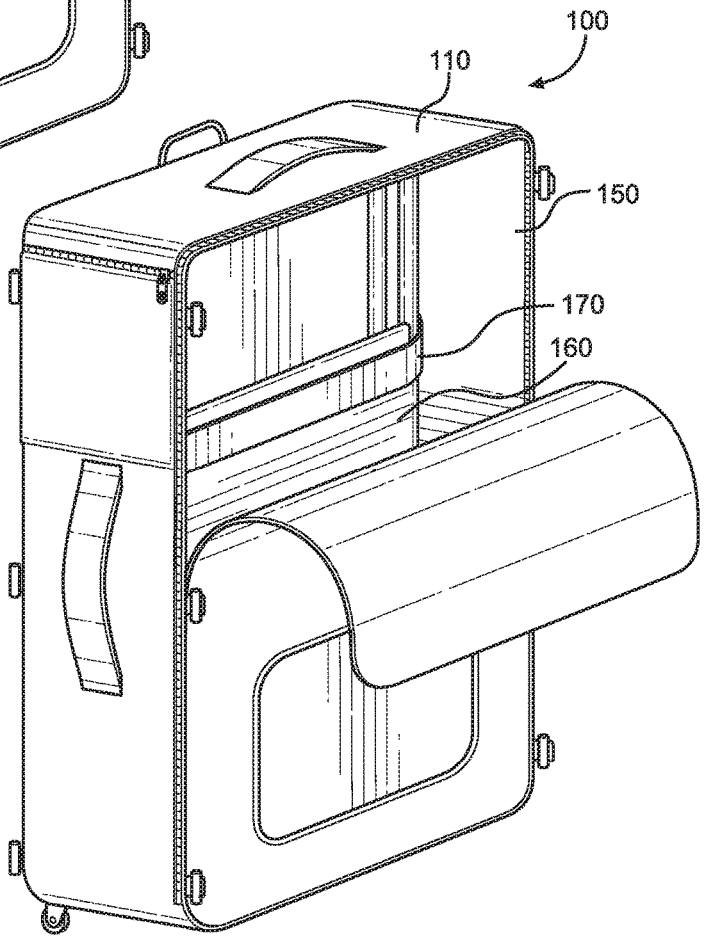
FIG. 1B shows a perspective view of an embodiment of the carrier for multiple folding chairs in an open configuration, with flat-folding chairs secured in the interior.

Referring now to FIG. 1B, there is shown a perspective view of an embodiment of the carrier for multiple folding chairs in an open configuration, with flat-folding chairs secured in the interior. The body 110 is configured such that folding chairs 160 secured therein act as internal supports, thereby giving the carrier for multiple folding chairs 100 structural rigidity and stability. The interior volume 150 is configured to be large enough to encapsulate at least two folding chairs 160. Removably securable internal straps 170 secure the folding chairs 160, as shown in FIG. 1B, or folding chairs 160 that are placed within their individual carrying bags, as shown in FIG. 1A.

Figure 1C:
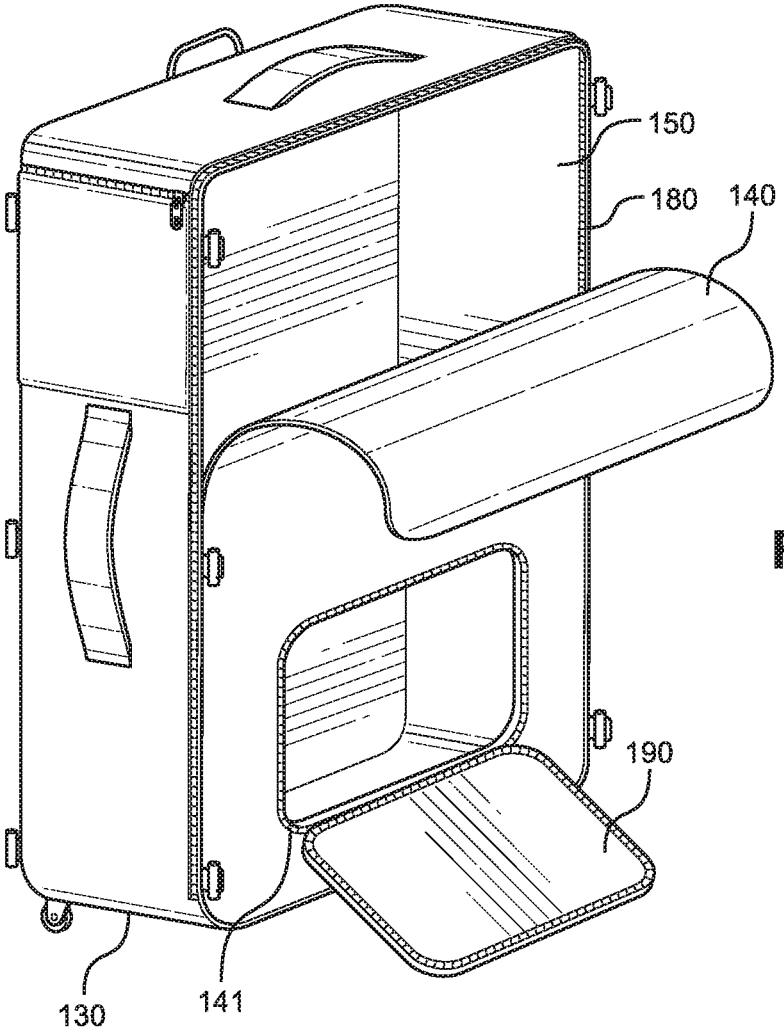
FIG. 1C shows a perspective view of an embodiment of the carrier for multiple folding chairs in an open configuration, wherein the carrier is empty.

Referring now to FIG. 1C, there is shown a perspective view of an embodiment of the carrier for multiple folding chairs in an open configuration, wherein the carrier is empty. In the shown embodiment, the closure flap 140 is removably secured along three of the four depicted sidewalls 130 via a zipper mechanism 180. In other embodiments, any other suitable fastener may be utilized to selectively secure the closure flap 140 in a closed position. The closure flap 140 further incorporates an access flap 190 disposed on the bottom end 141 of the closure flap 140. The access flap 190 is configured to be flexibly or hingedly secured on at least one end to the closure flap 140, such that an opposing end of the access flap 190 is removably securable to the closure flap 140 via any suitable closure mechanism, such as a zipper 180, for example.

In use, an individual may access the interior volume 150 while the closure flap 140 is in a closed configuration via the access flap 190. The access flap 190 allows an individual to place additional materials, including but not limited to blankets, jackets, and bags in the empty space left in the interior volume 150 where folding chairs 160 are already inside the carrier for multiple folding chairs 100.

Figure 2:
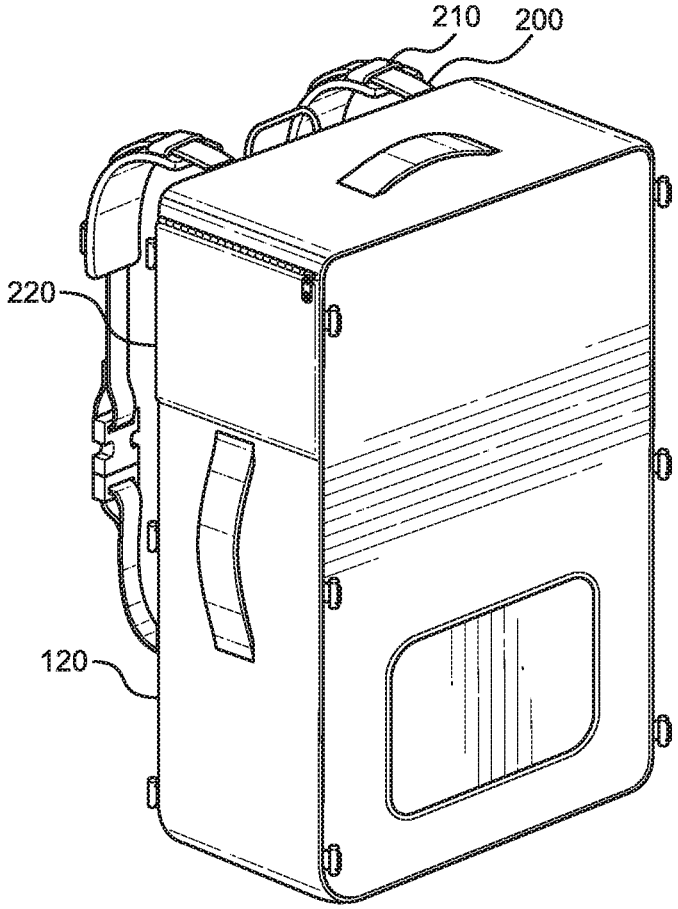
FIG. 2 shows a perspective view of an embodiment of the carrier for multiple folding chairs in a closed configuration.

Referring now to FIG. 2, there is shown a perspective view of an embodiment of the carrier for multiple folding chairs in a closed configuration. In the shown embodiment two shoulder straps 200 are disposed on the back 120 of the carrier for multiple folding chairs. In a further embodiment, the shoulder straps 200 are configured to receive a removably securable padding 210. In the shown embodiment, a pocket 220 is disposed on an exterior portion of a sidewall 120. The pocket 220 is sized to accept the removably securable padding 210 or other similarly-sized materials. In some embodiments, the pocket 220 includes a closure fastener, such as a zipper, for example. In other embodiments, multiple pockets 220 can be disposed on multiple exterior portions of the sidewalls 120.

Figure 3A:
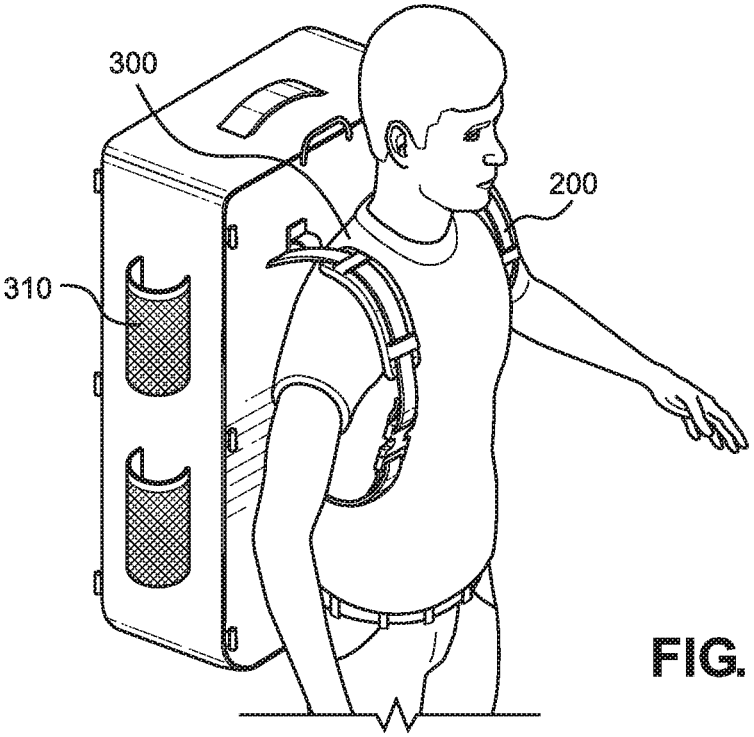
FIG. 3A shows a perspective view of an embodiment of the carrier for multiple folding chairs in a closed configuration, secured to and carried by an individual.

Referring now to FIG. 3A, there is shown a perspective view of an embodiment of the carrier for multiple folding chairs in a closed configuration, secured to and carried by an individual. In the shown embodiment, an individual can utilize the two shoulder straps 200 in order to removably secure the carrier for multiple folding chairs on the individual's shoulders 300. In this embodiment, removably securable padding is disposed around the circumference of the shoulder straps 200 to provide additional padding to the individual. The removably securable padding can be composed of a variety of materials that would provide cushioning and further support to the individual wearing the carrier for multiple folding chairs. The shoulder straps 200 are slidably adjustable in length such that the individual may adjust how the carrier for multiple folding chairs sits on their shoulders 300 for maximum comfort and stability.

In one embodiment, at least one netting 310 is disposed on one of the sidewalls. In the shown embodiment, two nettings 310 are secured, one above the other, to the sidewall, wherein each netting 310 defines a receptacle having an arcuate open upper end and a closed lower end. The nettings 310 in such embodiments are configured to removably receive and secure water bottles or similarly sized objects. One of ordinary skill in the art will understand that this disclosure is not limiting in any way the manner in which the netting 310 is utilized.

Figure 3B:
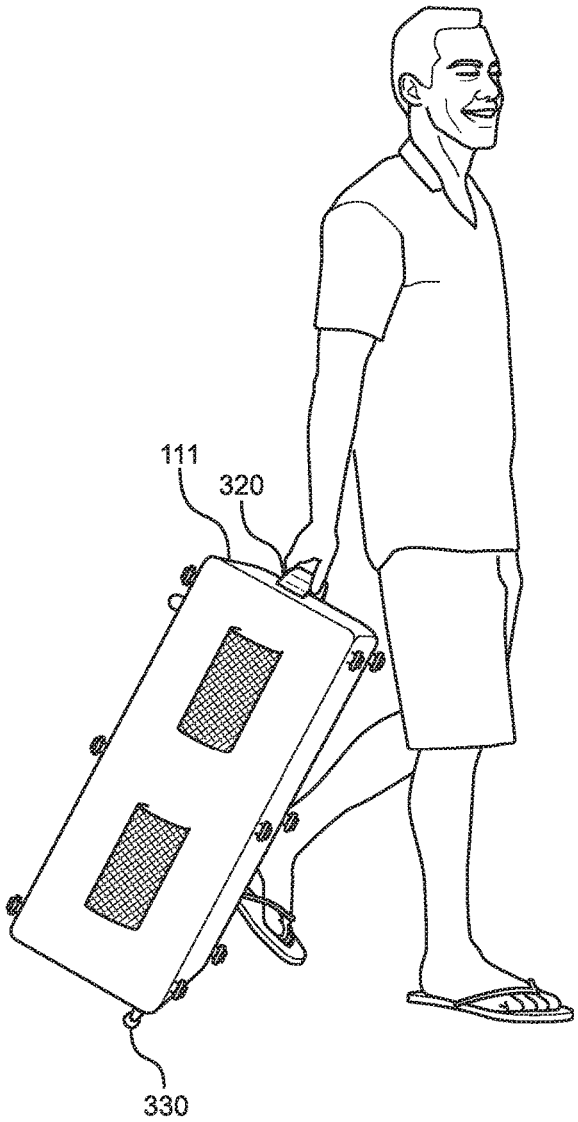
FIG. 3B shows a perspective view of an embodiment of the carrier for multiple folding chairs in a closed configuration being pulled by an individual utilizing the casters.

Referring now to FIG. 3B, there is shown a perspective view of an embodiment of the carrier for multiple folding chairs in a closed configuration, pulled by an individual utilizing the casters. In the shown embodiment, a top carrying handle 320 is disposed on the top end 111 of the body. The top carrying handle 320 includes an arcuate shape, that an individual can grasp the top carrying handle 320 through the opening defined by the opposing ends of the handle that connect to the body. Further, in the shown embodiment, two caster wheels 330 are disposed on opposite ends of the bottom end of the body. The two caster wheels 330 are configured to rotate and pivot freely. In use, an individual may transport the carrier for multiple folding chairs by pulling the top carrying handle 320 at an angle, thereby utilizing the caster wheels 330 by allowing the caster wheels 330 to roll along the ground.

Figure 3C:
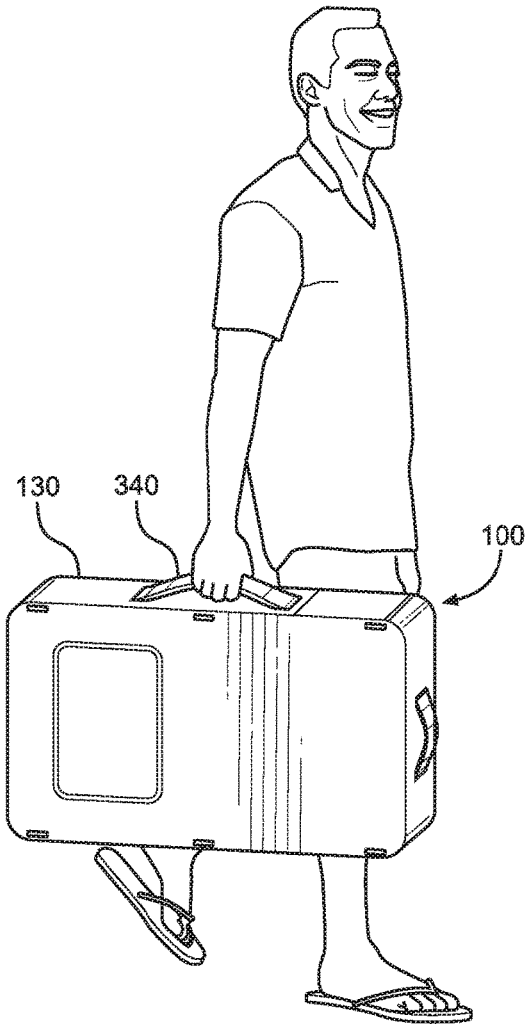
FIG. 3C shows a perspective view of an embodiment of the carrier for multiple folding chairs in a closed configuration, carried by an individual utilizing a handle.

Referring now to FIG. 3C, there is shown a perspective view of an embodiment of the carrier for multiple folding chairs in a closed configuration, carried by an individual utilizing a handle. In the shown embodiment, a side carrying handle 340 is disposed on an exterior portion of a sidewall 130. The side carrying handle 340 is secured in an arcuate configuration, such that an individual can grasp the side carrying handle 340. The side carrying handle 340 is configured to support the weight of a fully loaded carrier for multiple folding chairs 100 when held by an individual.

Figure 4:
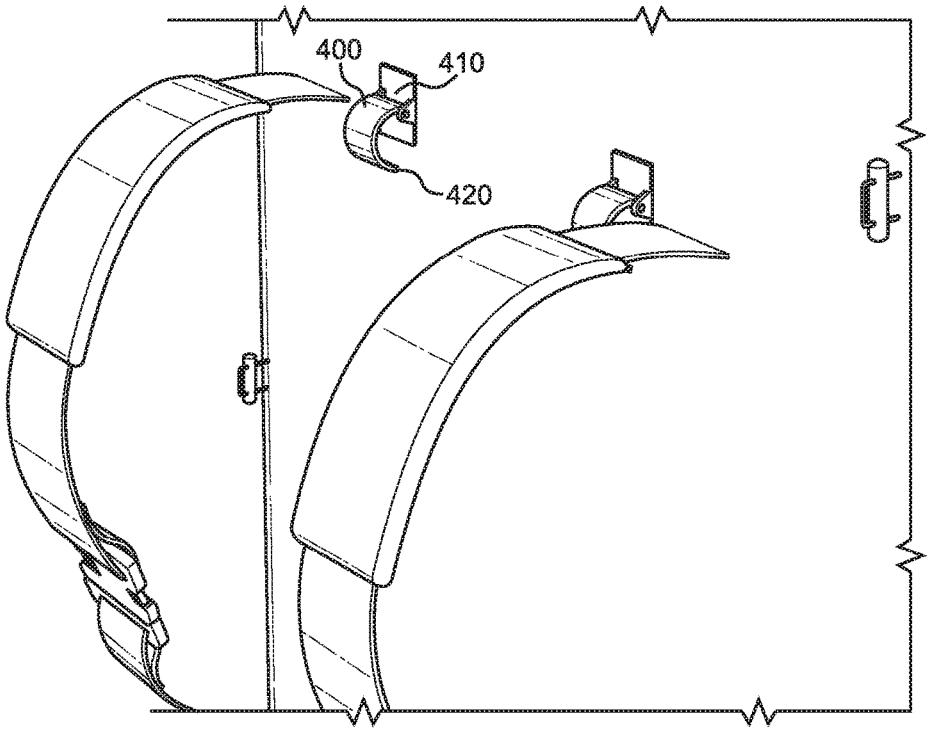
FIG. 4 shows a close-up view of the hooks and straps disposed on the back of the carrier for multiple folding chairs.

Referring now to FIG. 4, there is shown a close-up perspective view of the hooks and straps disposed on the back of the carrier for multiple folding chairs. In the shown embodiment, two mounting hooks 400 are hingedly secured to an exterior surface of the back of the carrier for multiple folding chairs. The first end 410 of the mounting hooks 400 are hingedly secured to the back of the body. The mounting hooks 400 include an arcuate shape or configuration, allowing the hooks 400 to effectively engage cylindrical structures or other similarly shaped structures. In one embodiment, the mounting hooks 400 are secured to the back of the body via a spring hinge, such that the second ends 420 of the mounting hooks 400 are biased against the back of the body in a default position.

Figure 5:
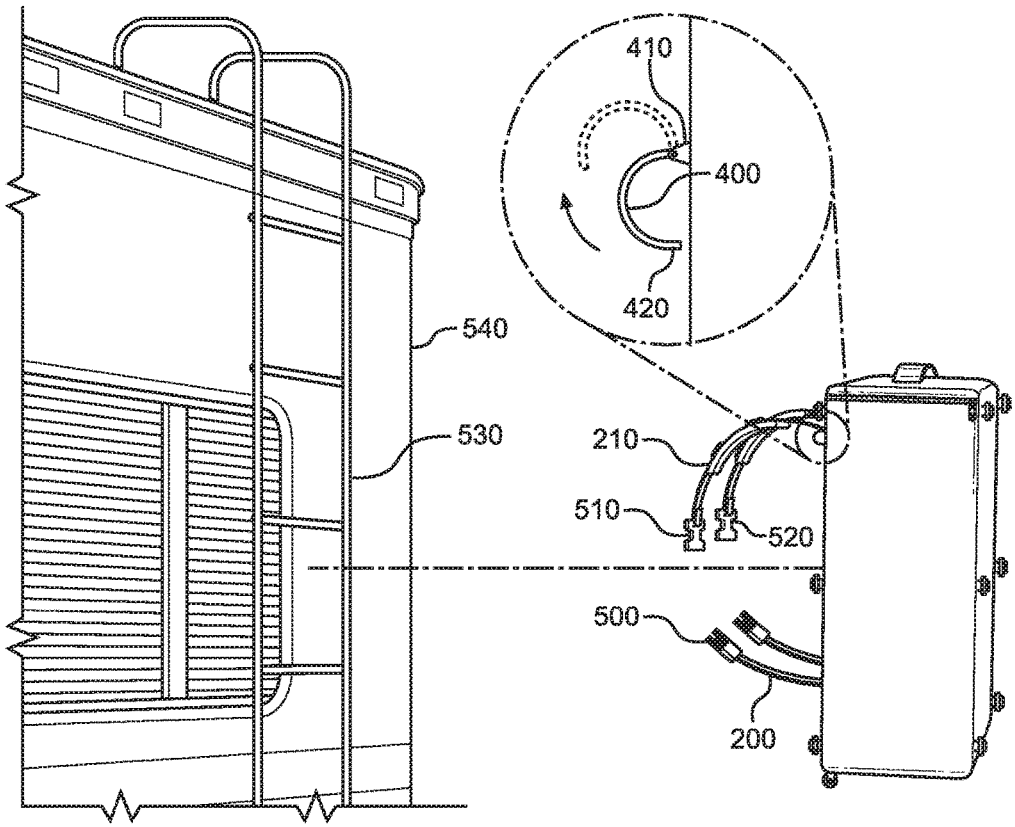
FIG. 5 shows a perspective view of an embodiment of the carrier for multiple folding chairs in a closed configuration, depicting a manner in which the carrier may be removably secured to a mounting fixture affixed to a vehicle.

Referring now to FIG. 5, there is shown a perspective view of an embodiment of the carrier for multiple folding chairs in a closed configuration, depicting a manner in which the carrier may be affixed to a mounting fixture affixed to a vehicle. In the shown embodiment, the two shoulder straps 200 comprise a side release buckle 500 and a complementary receiver 510 disposed at a midpoint 520 along the shoulder strap 200. The buckle 500 and complementary receiving fastener 510 of the shoulder strap 200 is configured to separate and re-attach at the midpoint 520 of the shoulder strap 200.

In use, the mounting hooks 400 are configured to aid in securing the carrier for multiple folding chairs to a mounting fixture 530 affixed to a vehicle 540. To secure the carrier to a vehicle, an individual raises the second end 420 of the mounting hooks 400 away from the back of the body, as shown in FIG. 5, and loops the second end 420 of the mounting hooks 400 around the mounting fixture 530, which has been previously affixed to a vehicle 540. In the illustrated embodiment, the mounting fixture 530 is a roof access ladder secured to the rear of the vehicle. However, in alternate embodiments, the mounting fixture 530 can be any suitable structure secured to or integral to the vehicle to which the mounting hooks 400 can be secured. The mounting hooks 400 are configured to support the weight of the carrier for multiple folding chairs when fully loaded, and the second ends of the mounting hooks 400 are biased against the back of the body.

In this manner an individual can place the carrier for multiple folding chairs on the mounting fixture 530 affixed to a vehicle 540, let go of the carrier for multiple folding chairs and the carrier for multiple folding chairs will be supported on the mounting fixture 530. The individual is thereby enabled to further secure the carrier for multiple folding chairs to the mounting fixture 530 by separating the shoulder strap 200 at the midpoint 520 of the shoulder strap 200 via means of the buckle 500 and complementary receiving fastener 510. The individual may thereby encircle the mounting fixture 530 with the should strap 200 and slidably adjust the length of the shoulder strap 200 in order to further secure the carrier for multiple folding chairs to the mounting fixture 530.

Figure 6:
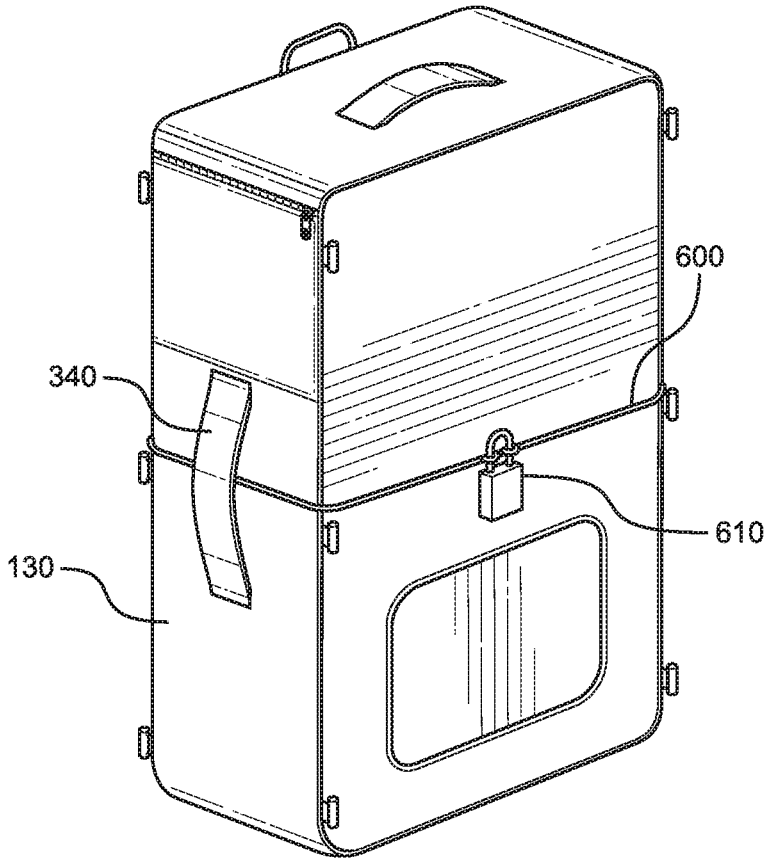
FIG. 6 shows a perspective view of an embodiment of the carrier for multiple folding chairs in a closed configuration, with a cable and a lock disposed around the exterior perimeter of the body.

Referring now to FIG. 6, there is shown a perspective view of an embodiment of the carrier for multiple folding chairs in a closed configuration, with a cable and a lock disposed around the exterior perimeter of the body. The body is configured to accept a cable 600 disposed about the exterior perimeter of the body. In the shown embodiment, the cable 600 is laced between the sidewall 130 and the side handle 340. It is contemplated by this disclosure that many different configurations of disposing the cable 600 around the body are possible and embody the present invention. Further, in the shown embodiment, the cable 600 is configured to accept a lock 610. By securing the cable 600 around the body via a lock 610 an individual can selectively secure the contents of the carrier for multiple folding chains, such that the individual is able to prevent un-authorized access therein.

Figure 7:
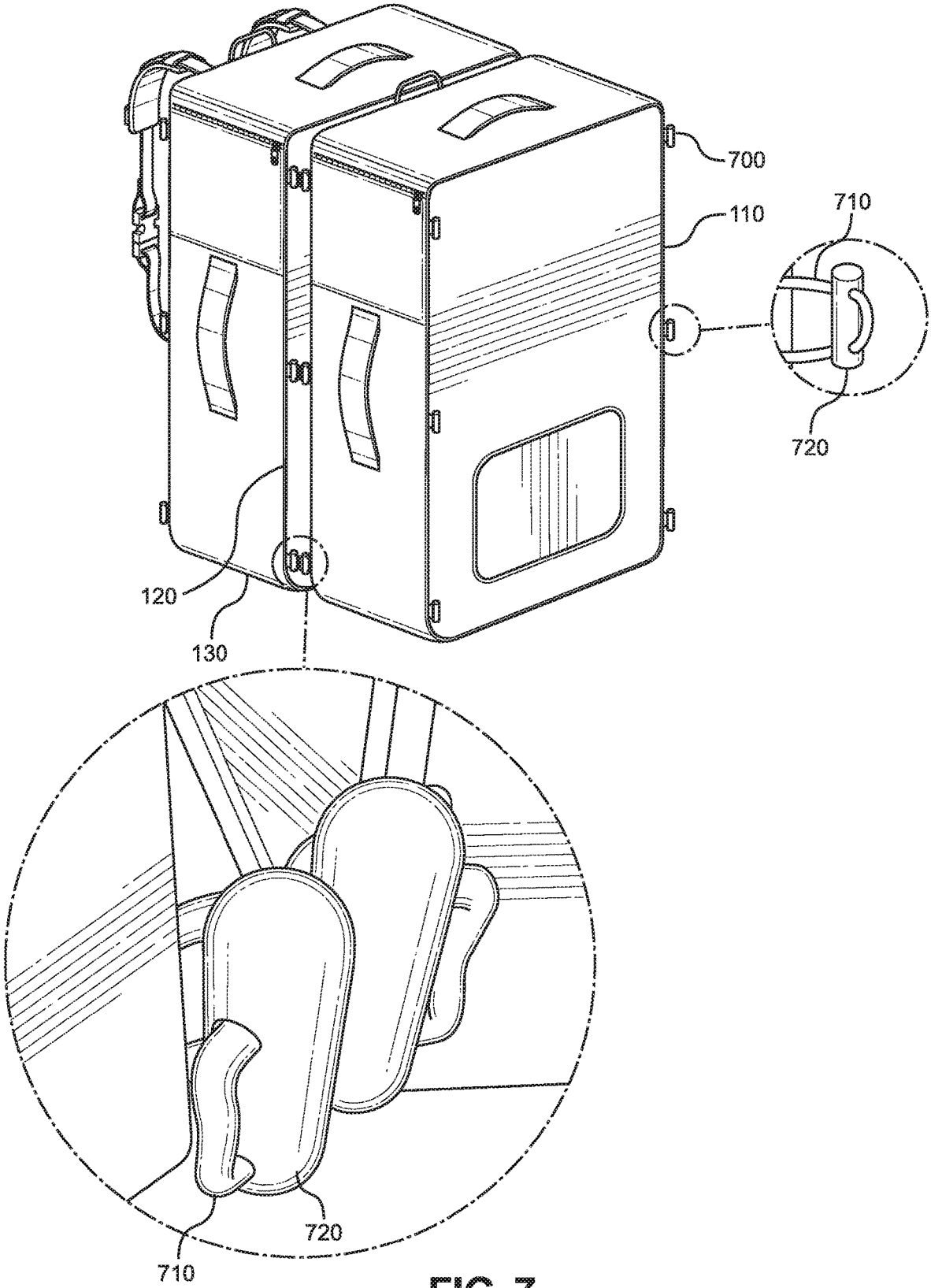
FIG. 7 shows a perspective view of an embodiment of the carrier for multiple folding chairs, with a call-out view detailing the plurality of loops and how they may interconnect to secure one carrier to another.

Referring now to FIG. 7, there is shown a perspective view of an embodiment of the carrier for multiple folding chairs, with a call-out view detailing the plurality of loops and how they may interconnect to secure one carrier to another. A plurality of loops 700 are disposed along the exterior surface of the body 110. In the shown embodiment the plurality of loops 700 are disposed along the seams between the back 120 and the sidewall 130, and the seams are positioned between the sidewall 130 and the closure flap. In the shown embodiment the plurality of loops 700 comprise a flexible tubing 710 laced through a rigid cylinder 720, wherein the flexible tubing 710 is secured to the body 110 in an arcuate configuration. In another embodiment the plurality of loops 700 are configured as "D"-shaped rings. It is contemplated by this disclosure that many different types of connectors are possible and within the scope of the present invention.

The plurality of loops 700 are configured to secure an object to the body 110 of the carrier for multiple folding chairs. In the shown embodiment, the plurality of loops 700 of one carrier for multiple folding chairs are interlaced with the plurality of loops 700 of another carrier for multiple folding chairs. In this manner an individual can securely attach one carrier for multiple folding chairs to another carrier for multiple folding chairs, thereby enabling the individual to carry two carriers for multiple folding chairs at once.

Figure 8:
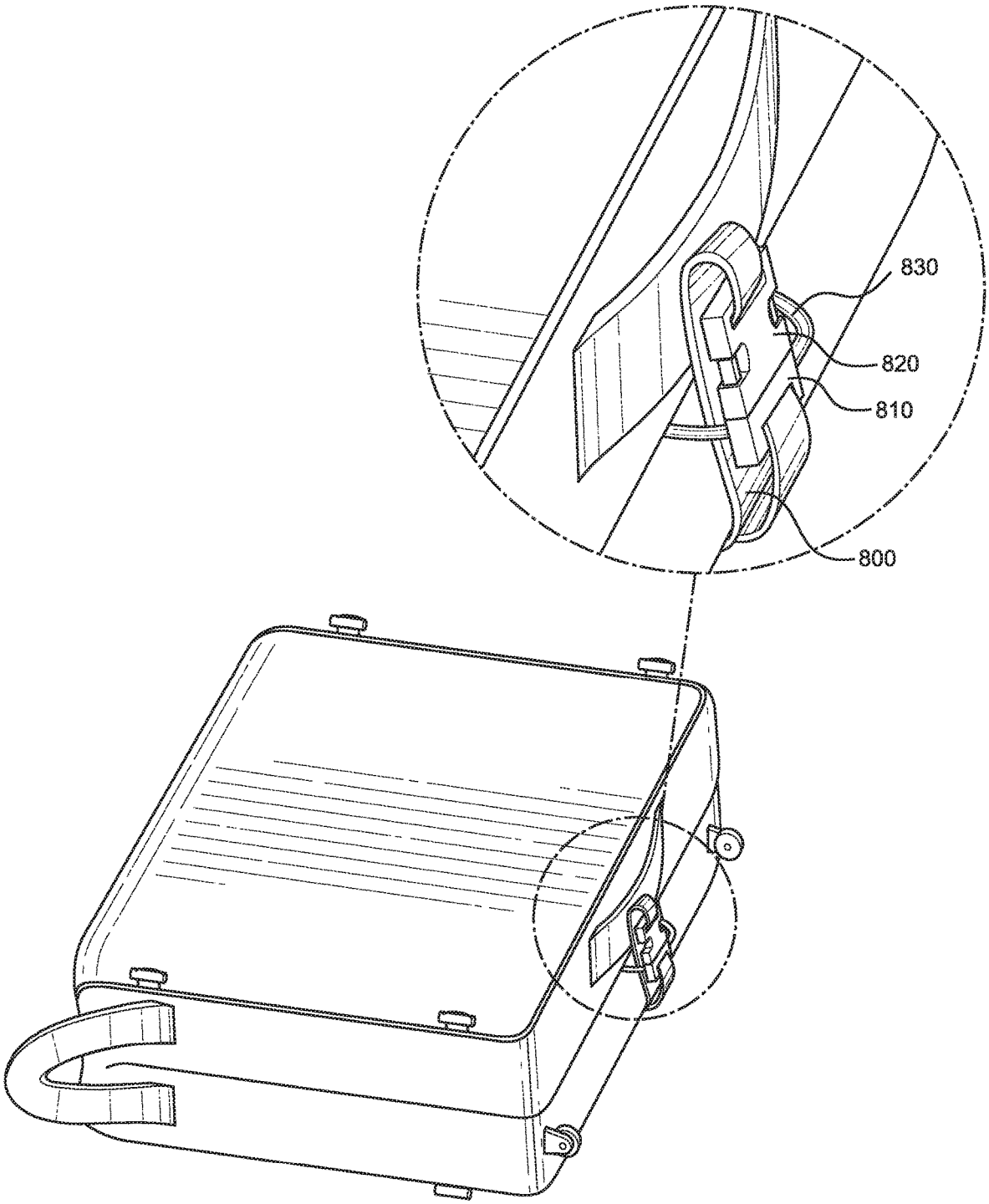
FIG. 8 shows a perspective view of an embodiment of the carrier for multiple folding chairs in a folded configuration.

Referring now to FIG. 8, there is shown a perspective view of an embodiment of the carrier for multiple folding chairs in a folded configuration. In the illustrated embodiment, the carrier for multiple folding chairs is comprised of a flexible material. A looped webbing 830 is disposed in an arcuate configuration along the top end of the back of the body. An attachment mechanism can be utilized when the carrier for multiple folding chairs is folded to keep the carrier for multiple folding chairs in the folded configuration. In the shown embodiment, the attachment mechanism comprises a belt 800 secured to the bottom end of the back of the body, at a midpoint between the casters. The belt 800 further comprises a side release buckle 810 and a complementary receiving fastener 820.

In the shown embodiment, an individual can secure the carrier for multiple folding chairs in a folded configuration by detaching the side release buckle 810 from its complementary receiver 820, thereby separating the belt 800. The individual may thereby encircle the looped webbing 830 with the belt 800 and reattach the belt 800 via the side release buckle 810 and the complementary receiver 820 in order to secure the carrier for multiple folding chairs in a folded configuration.

Figure 9:
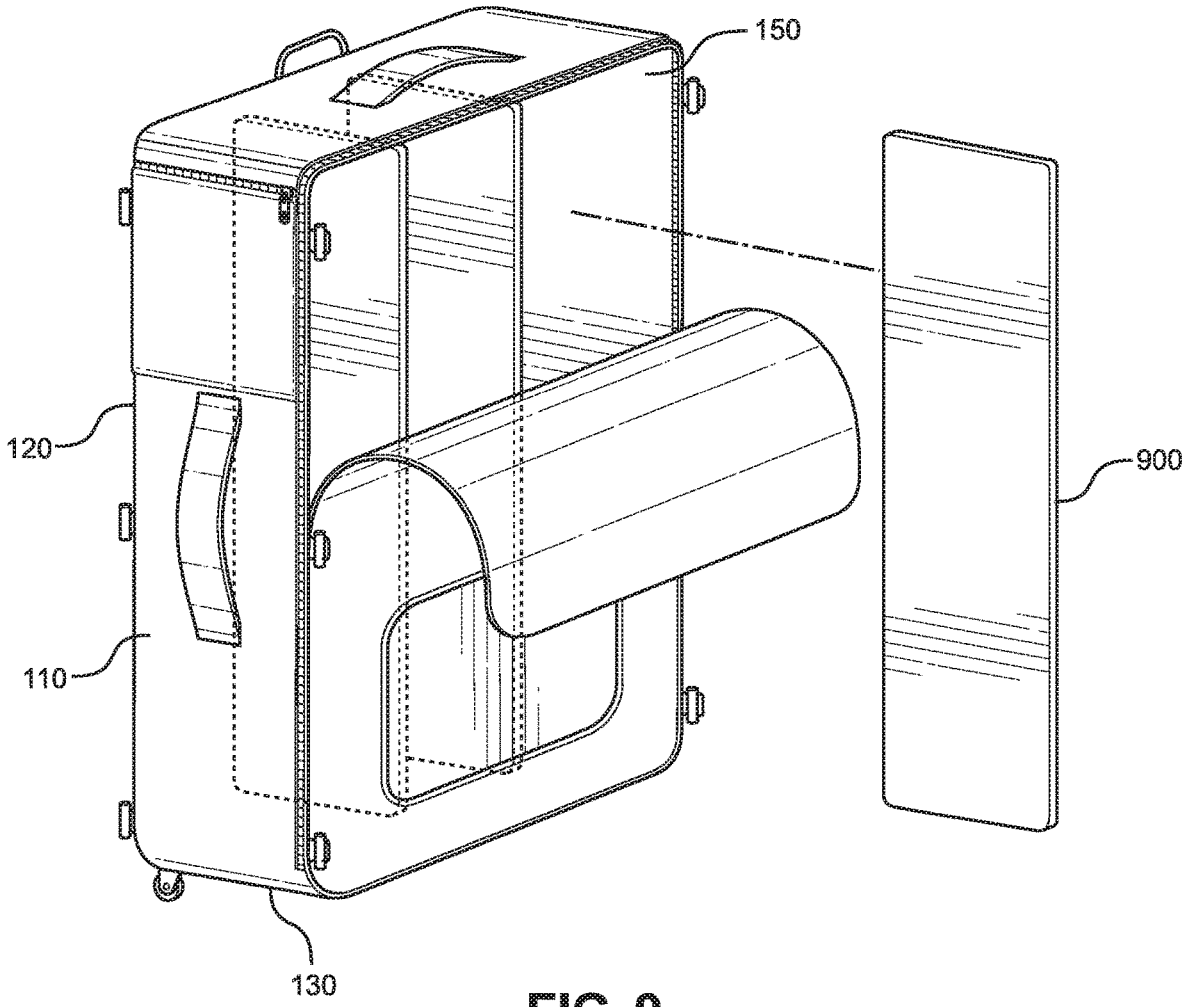
FIG. 9 shows a perspective view of an embodiment of the carrier for multiple folding chairs with removable interior walls.

Referring now to FIG. 9, there is shown a perspective view of an embodiment of the carrier for multiple folding chairs depicting removable interior walls. In the shown embodiment, a plurality of removably securable dividing walls 900 are disposed in the interior volume 150. In one embodiment, the length of the removably securable dividing walls 900 corresponds to the length of the back 120 of the body 110, and the width of the removably securable dividing walls 900 corresponds to the width of the sidewalls 130. It is contemplated by this disclosure that many different configurations, sizes and shapes of removably securable dividing walls 900 are possible and embody the present invention.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrier for multiple folding chairs, comprising:

a body including a back;

at least one sidewall disposed around a perimeter of the back, thereby defining an interior volume configured to encapsulate at least two folding chairs;

a closure flap having a top end and a bottom end, the closure flap configured to be removably secured to an open end of the sidewall;

the closure flap further comprising an access flap;

wherein the access flap is disposed on the bottom end of the closure flap, is configured to be secured to the body at one end of the access flap, and is configured to be removably securable to the body at a second end of the access flap via an access flap fastener, such that an individual may access the interior volume through the access flap;

at least one shoulder strap disposed on an exterior surface of the body;

a mounting hook;

wherein the mounting hook comprises a first end and a second end;

wherein the first end of the mounting hook is hingedly secured to the back of the body;

wherein the entire mounting hook extends outwardly from the body in an arcuate configuration;

wherein the second end of the mounting hook is biased to rest against the back of the body in a folded configuration; and wherein the mounting hook is configured to removably secure the carrier for multiple folding chairs to a mounting fixture.

2. The carrier for multiple folding chairs of claim 1, wherein at least one top carrying handle is disposed on an exterior portion of the at least one sidewall.

3. The carrier for multiple folding chairs of claim 1, wherein at least one side carrying handle is disposed on an exterior portion of the at least one sidewall.

4. The carrier for multiple folding chairs of claim 1, further comprising a removably securable padding, wherein the at least one shoulder strap is configured to receive the removably securable padding.

5. The carrier for multiple folding chairs of claim 1, wherein a length of the at least one shoulder strap is configured to be adjustable.

6. The carrier for multiple folding chairs of claim 1, wherein a cable extends about an exterior perimeter of the body, the cable configured to engage a lock.

7. The carrier for multiple folding chairs of claim 1, wherein at least one pocket is disposed on an exterior surface of the at least one sidewall.

8. The carrier for multiple folding chairs of claim 1, wherein a plurality of loops is disposed along an exterior surface of the at least one sidewall, wherein the plurality loops are configured to removably secure at least one additional object to the carrier.

9. The carrier for multiple folding chairs of claim 8, wherein a first carrier for multiple folding chairs is connected via the plurality of loops to an identical second carrier for multiple folding chairs.

10. The carrier for multiple folding chairs of claim 1, wherein at least two caster wheels are disposed on an exterior of the back.

11. The carrier for multiple folding chairs of claim 1, further comprising at least one removably securable dividing wall configured to define individual compartments in the interior volume of the body, wherein each of the individual compartments are configured to encapsulate at least one folding chair.

12. The carrier for multiple folding chairs of claim 1, further comprising at least one removably securable internal strap disposed in the interior volume of the body, configured to secure individual folding chairs within the interior volume.

13. The carrier for multiple folding chairs of claim 1, wherein the closure flap is permanently secured to the body along at least one edge of the closure flap.

14. The carrier for multiple folding chairs of claim 1, wherein a looped webbing is disposed along a top portion of the back of the carrier for multiple folding chairs.

15. The carrier for multiple folding chairs of claim 1, further comprising an attachment mechanism that is configured to secure a top portion of the back to a bottom portion of the back in a collapsed, folded configuration.

16. The carrier for multiple folding chairs of claim 1, wherein at least one netting is disposed on the at least one sidewall, wherein the at least one netting is configured to removably secure a water bottle therein.

17. The carrier for multiple folding chairs of claim 1, wherein the at least one shoulder strap further comprises a side release buckle and a complementary receiver disposed at a midpoint along the shoulder strap, such that the shoulder strap is configured to separate and attach at the midpoint along the shoulder strap via the side release buckle and complementary receiver.

18. The carrier for multiple folding chairs of claim 1, wherein the mounting hook is semicircular.

19. The carrier for multiple folding chairs of claim 8, wherein each of the plurality of loops comprise a flexible tubing laced through a rigid cylinder, wherein the flexible tubing is secured to the body in an arcuate configuration.

20. A carrier for multiple folding chairs, consisting of:

a body formed from a front wall, a rear wall, and a sidewall disposed around a perimeter of the back, thereby defining an interior volume sized and shaped to encapsulate at least two folding chairs;

a closure flap having a top end and a bottom end, the closure flap removably securable to an open end of the sidewall;

the closure flap further comprising an access flap;

wherein the access flap is disposed on the bottom end of the closure flap, is configured to be secured to the body at one end of the access flap, and is configured to be removably securable to the body at a second end of the access flap via an access flap fastener, such that an individual may access the interior volume through the access flap;

at least one shoulder strap disposed on an exterior surface of the body;

a mounting hook;

wherein the mounting hook comprises a first end and a second end;

wherein the first end of the mounting hook is hingedly secured to the back of the body;

wherein the entire mounting hook extends outwardly from the body in an arcuate configuration;

wherein the second end of the mounting hook is biased to rest against the back of the body;

wherein the mounting hook is configured to removably secure the carrier for multiple folding chairs to a mounting fixture.

* * * * *